US007175573B1

(12) United States Patent
Huang

(10) Patent No.: US 7,175,573 B1
(45) Date of Patent: Feb. 13, 2007

(54) EXERCISING DEVICE HAVING MULTIPLE FUNCTIONS

(76) Inventor: Chin-Chen Huang, 27, Alley 33, Lane 279, Sec. 2, Yuan Lu Rd., Fu Hsing Hsiang, Changhua Hsien (TW)

( * ) Notice: Subject to any disclaimer, the term of this patent is extended or adjusted under 35 U.S.C. 154(b) by 0 days.

(21) Appl. No.: 11/120,000

(22) Filed: May 2, 2005

(51) Int. Cl.
*A63B 21/22* (2006.01)

(52) U.S. Cl. ..... 482/110; 482/132; 482/139; 446/236

(58) Field of Classification Search ..... 482/110, 482/140, 114, 115, 118, 106–109, 122, 126, 482/148; 446/450, 452–3, 221, 233, 235
See application file for complete search history.

(56) References Cited

U.S. PATENT DOCUMENTS 2,920,418 A * 1/1960 Britt ..... 446/241
3,482,835 A * 12/1969 Dean ..... 482/108
5,871,423 A * 2/1999 Pruchnik ..... 482/110
6,099,444 A * 8/2000 Domenge ..... 482/110
6,719,675 B2 * 4/2004 Yu ..... 482/110
6,773,377 B1 * 8/2004 Yu et al. ..... 482/45
6,837,377 B2 * 1/2005 Shuert ..... 206/599
2005/0101454 A1 * 5/2005 Dworzan ..... 482/110

* cited by examiner

*Primary Examiner*—Stephen R. Crow
*Assistant Examiner*—Allana Lewin
(74) *Attorney, Agent, or Firm*—Alan D. Kamrath; Nikolai & Mersereau, P.A.

(57) ABSTRACT

An exercising device includes a shaft, a rotation disk, a weight, two connecting members, two handles, two fixing members, and two pull cords. Thus, each of the two pull cords is attached to or removed from a respective one of the two fixing members, and one of the two handles is mounted on or removed from the shaft, so that the exercising device has multiple exercising functions, thereby enhancing the exercising effect of the exercising device.

8 Claims, 9 Drawing Sheets

EXERCISING DEVICE HAVING MULTIPLE FUNCTIONS

BACKGROUND OF THE INVENTION

1. Field of the Invention

The present invention relates to an exercising device, and more particularly to an exercising device having multiple exercising functions, thereby enhancing the exercising effect of the exercising device.

2. Description of the Related Art

A conventional exercising device, such as a dumbbell, a jump rope, a chest expander, a barbell or the like, is used to exercise a user's body so as to provide an exercising effect to the user. However, the conventional exercising device only has a single function, thereby greatly limiting the versatility of the exercising device.

SUMMARY OF THE INVENTION

In accordance with the present invention, there is provided an exercising device, comprising a shaft, a rotation disk rotatably mounted on the shaft, and a weight mounted on the rotation disk eccentrically.

The primary objective of the present invention is to provide an exercising device having multiple exercising functions, thereby enhancing the exercising effect of the exercising device.

Another objective of the present invention is to provide an exercising device, wherein when a user faces the ground, his two hands hold and apply a force to the grip portion of each of the two handles so that the two handles are moved forward and forward successively to drive the rotation disk to rotate on the ground, thereby exercising the user's two arms and his abdomen.

A further objective of the present invention is to provide an exercising device, wherein when a user is seated on a chair, his two legs steps on the grip portion of each of the two handles to drive the rotation disk to rotate on the ground and his two hands hold and apply a force to the holding portion of each of the two pull cords to extend the two pull cords, thereby exercising the user's two arms and two feet.

A further objective of the present invention is to provide an exercising device, wherein when a user stands up, his two hands hold and apply a force to the holding portion of each of the two pull cords to suspend the rotation disk in the air and to swing the whole exercising device, thereby exercising the user's two arms and his back.

A further objective of the present invention is to provide an exercising device, wherein when a user stands up, his two hands hold and apply a force to the grip portion of each of the two handles to shake the rotation disk so that the rotation disk is rotated relative to the two handles so as to rotate the weight eccentrically, thereby exercising the user's two arms and hands.

A further objective of the present invention is to provide an exercising device, wherein when one of the two handles is removed, the user's one hand can hold the grip portion of the other handle to shake and rotate the rotation disk so as to rotate the weight eccentrically, thereby exercising the user's one arm and hand.

Further benefits and advantages of the present invention will become apparent after a careful reading of the detailed description with appropriate reference to the accompanying drawings.

DETAILED DESCRIPTION OF THE INVENTION

Figure 1:
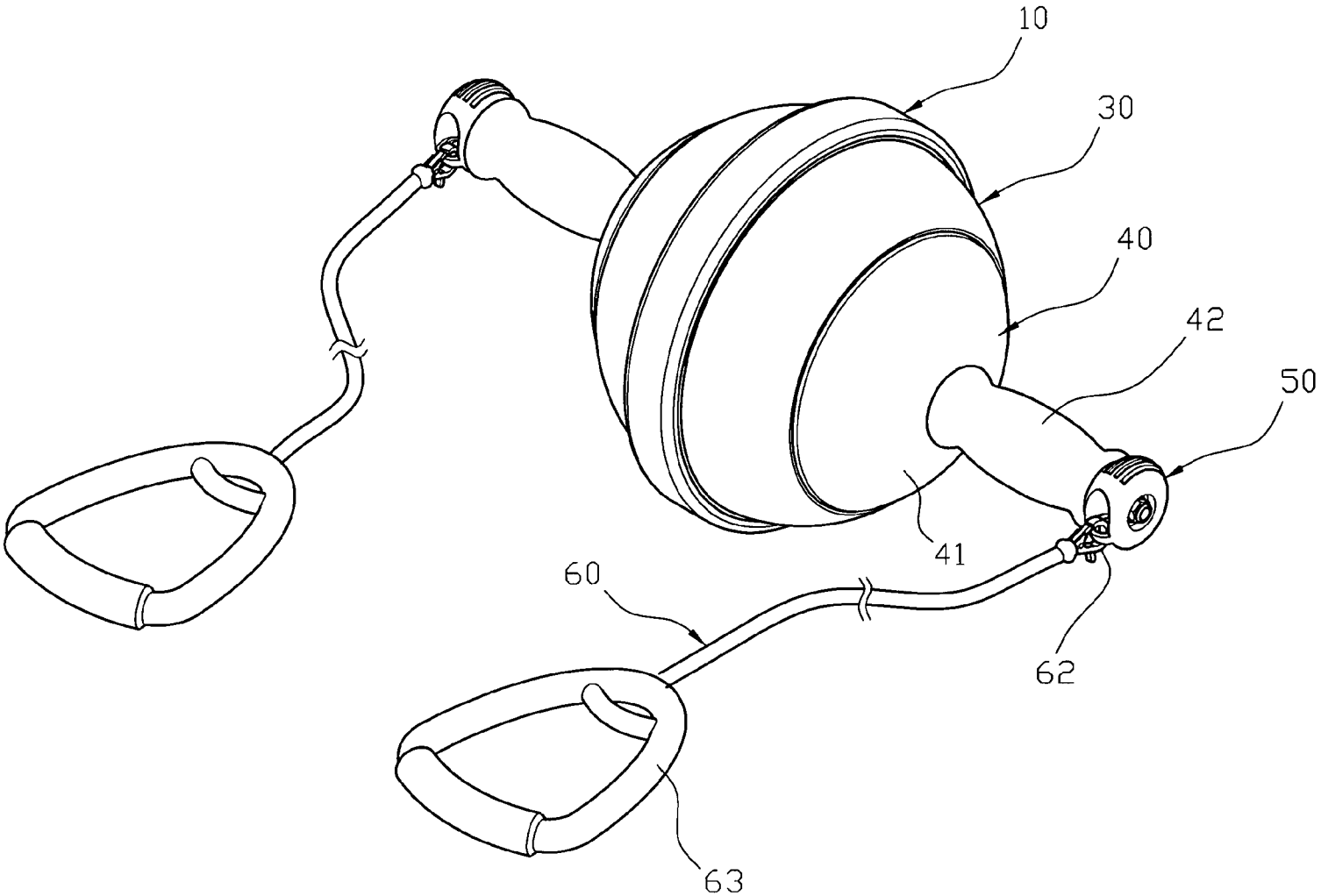
FIG. 1 is a perspective view of an exercising device in accordance with the preferred embodiment of the present invention.
Figure 2:
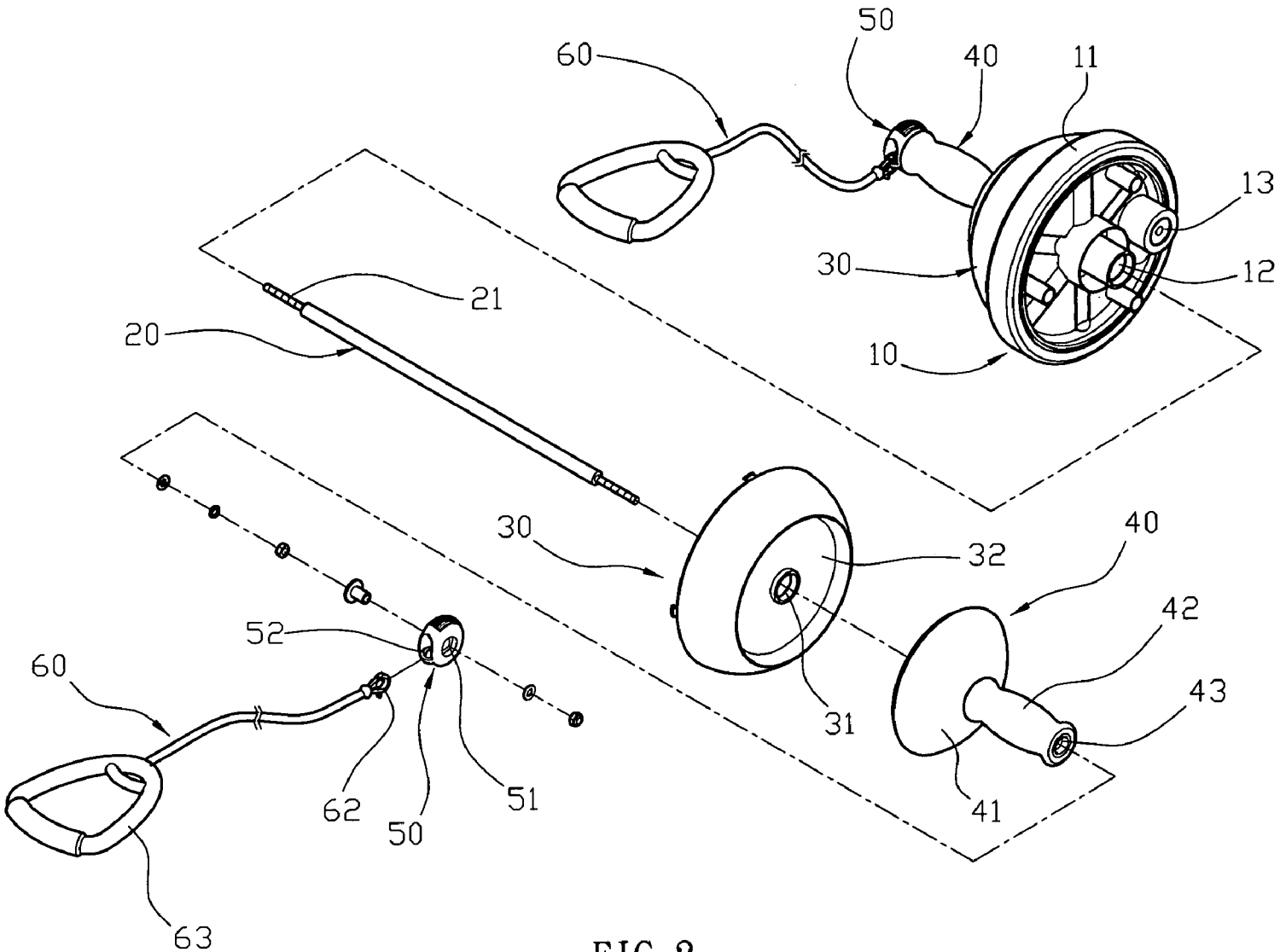
FIG. 2 is an exploded perspective view of the exercising device as shown in FIG. 1.

Referring to the drawings and initially to FIGS. 1 and 2, an exercising device in accordance with the preferred embodiment of the present invention comprises a shaft 20, a rotation disk 10 rotatably mounted on the shaft 20, a weight 13 mounted on the rotation disk 10 eccentrically, two connecting members 30 rotatably mounted on the shaft 20 and located at two sides of the rotation disk 10, two handles 40 each secured on the shaft 20 and each rested on a respective one of the two connecting members 30, two fixing members 50 each secured on the shaft 20 and each rested on a respective one of the two handles 40, and two pull cords 60 each detachably attached to a respective one of the two fixing members 50.

The rotation disk 10 is sandwiched between the two connecting members 30. The rotation disk 10 has a outer periphery formed with a rolling portion 11 and has a central portion formed with a through hole 12 rotatably mounted on the shaft 20. The weight 13 has a substantially cylindrical shape. The weight 13 is embedded into a side of the rotation disk 10 eccentrically.

The shaft 20 has two ends each formed with a threaded locking portion 21.

Each of the two connecting members 30 has a substantially semi-spherical shape. Each of the two connecting members 30 is secured on the rotation disk 10 to rotate therewith and has a central portion formed with a through hole 31 rotatably mounted on the shaft 20. Each of the two connecting members 30 has a side formed with a circular receiving recess 32.

Each of the two handles 40 has a first end formed with a support disk 41 rested on the respective connecting member 30 and a second end formed with a grip portion 42. The support disk 41 of each of the two handles 40 is rotatably mounted in the receiving recess 32 of the respective connecting member 30 so that each of the two connecting members 30 is rotatable relative to the respective handle 40 when the rotation disk 10 is rotated. Each of the two handles 40 has a central portion formed with a mounting hole 43 mounted on the shaft 20. The locking portion 21 of the shaft 20 is protruded outward from the grip portion 42 of each of the two handles 40.

Each of the two fixing members 50 has a central portion formed with a threaded locking hole 51 locked onto the respective locking portion 21 of the shaft 20 and has a side formed with a snapping portion 52. The shaft 20, the handles 40 and the fixing members 50 are combined with each other, and the rotation disk 10 and the connecting members 30 are rotatably mounted on the shaft 20.

Each of the two pull cords 60 has a first end provided with a snapping head 62 detachably snapped into snapping portion 52 of the respective fixing member 50 and a second end provided with a loop-shaped holding portion 63.

Figure 3:
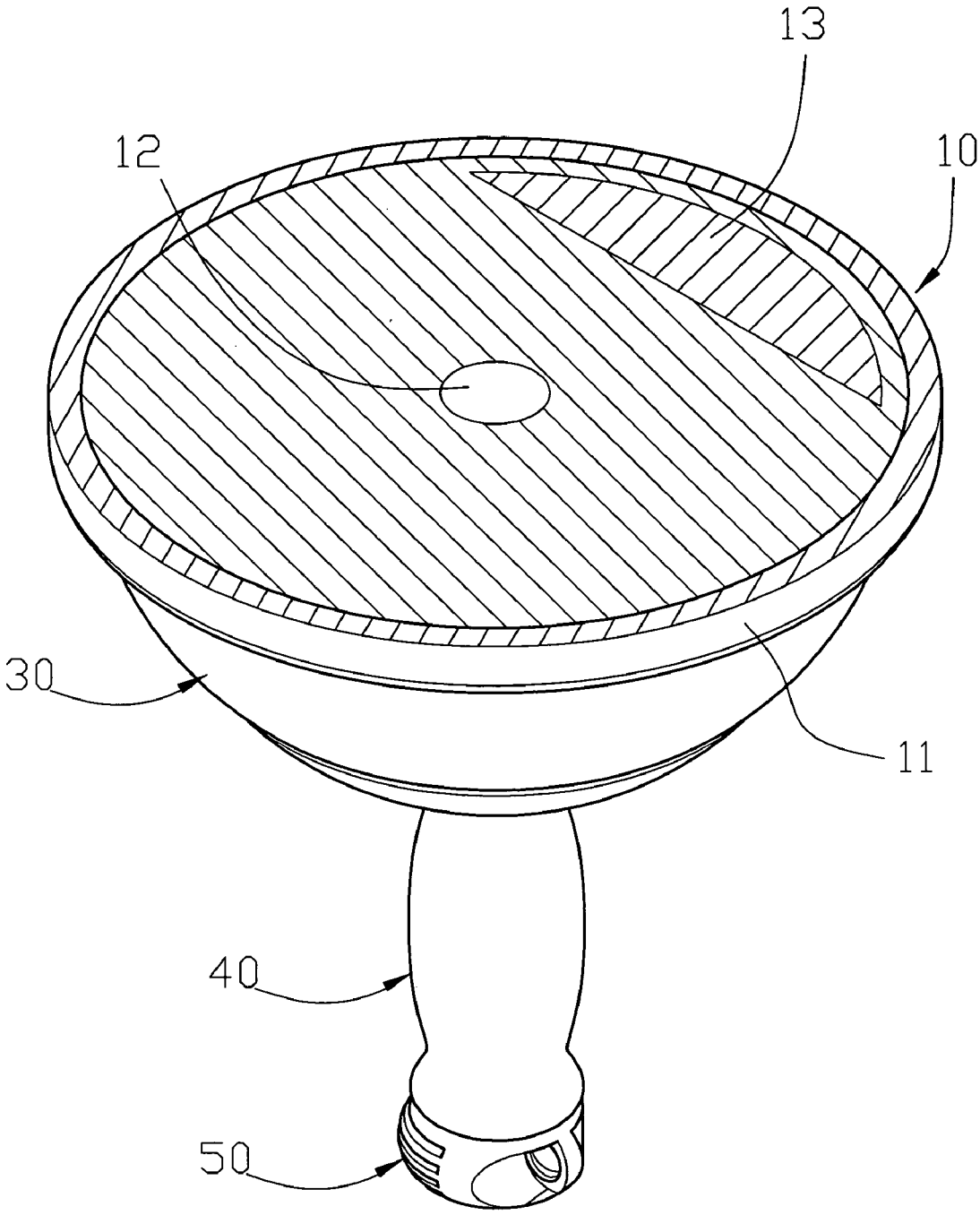
FIG. 3 is a partially perspective cross-sectional view of an exercising device in accordance with another embodiment of the present invention.

Referring to FIG. 3, the weight 13 has a substantially chamfered shape.

Figure 4:
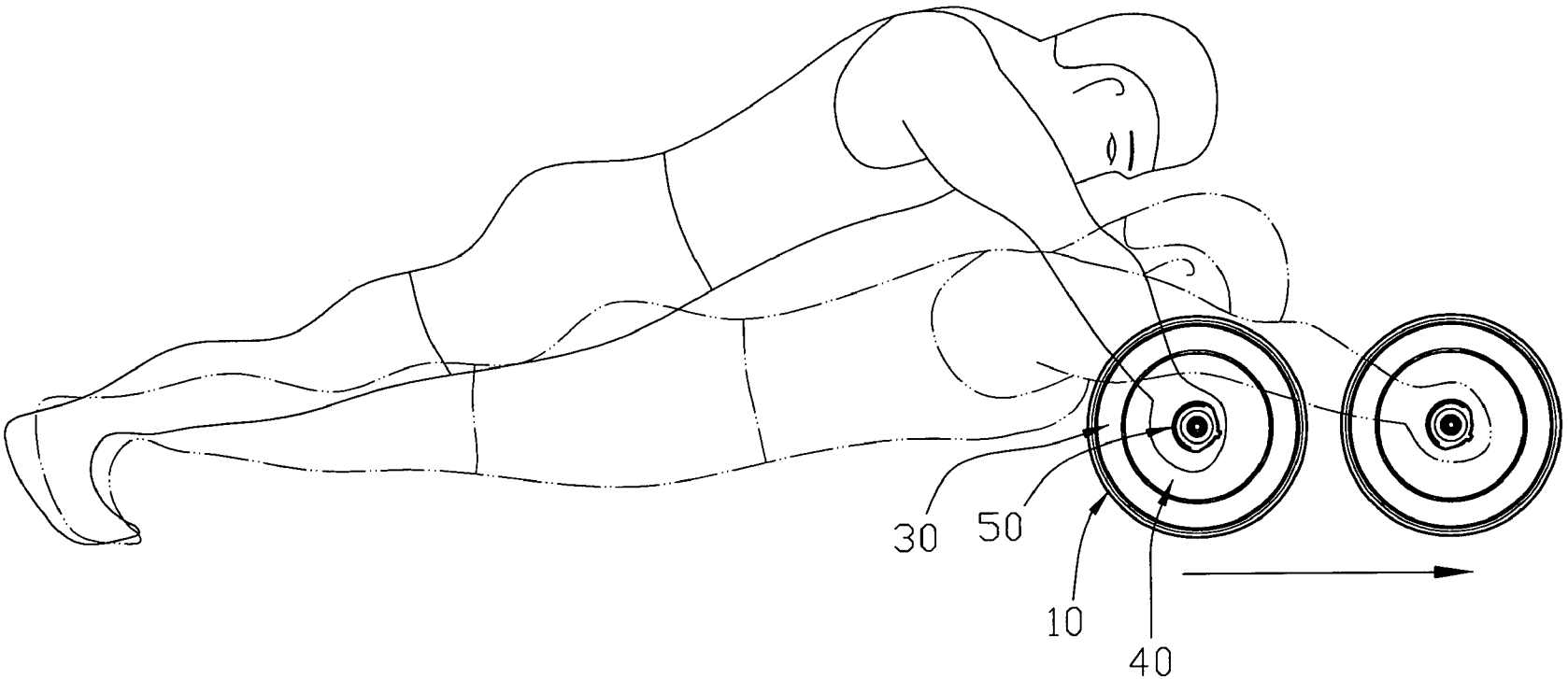
FIG. 4 is a schematic plan operational view of the exercising device as shown in FIG. 1.

Referring to FIG. 4 with reference to FIGS. 1 and 2, each of the two pull cords 60 is removed from a respective one of the two fixing members 50, and the rotation disk 10 is placed on the ground. Thus, when a user faces the ground, his two hands hold and apply a force to the grip portion 42 of each of the two handles 40 so that the two handles 40 are moved forward and forward successively to drive the rotation disk 10 to rotate on the ground, thereby exercising the user's two arms and his abdomen.

Figure 5:
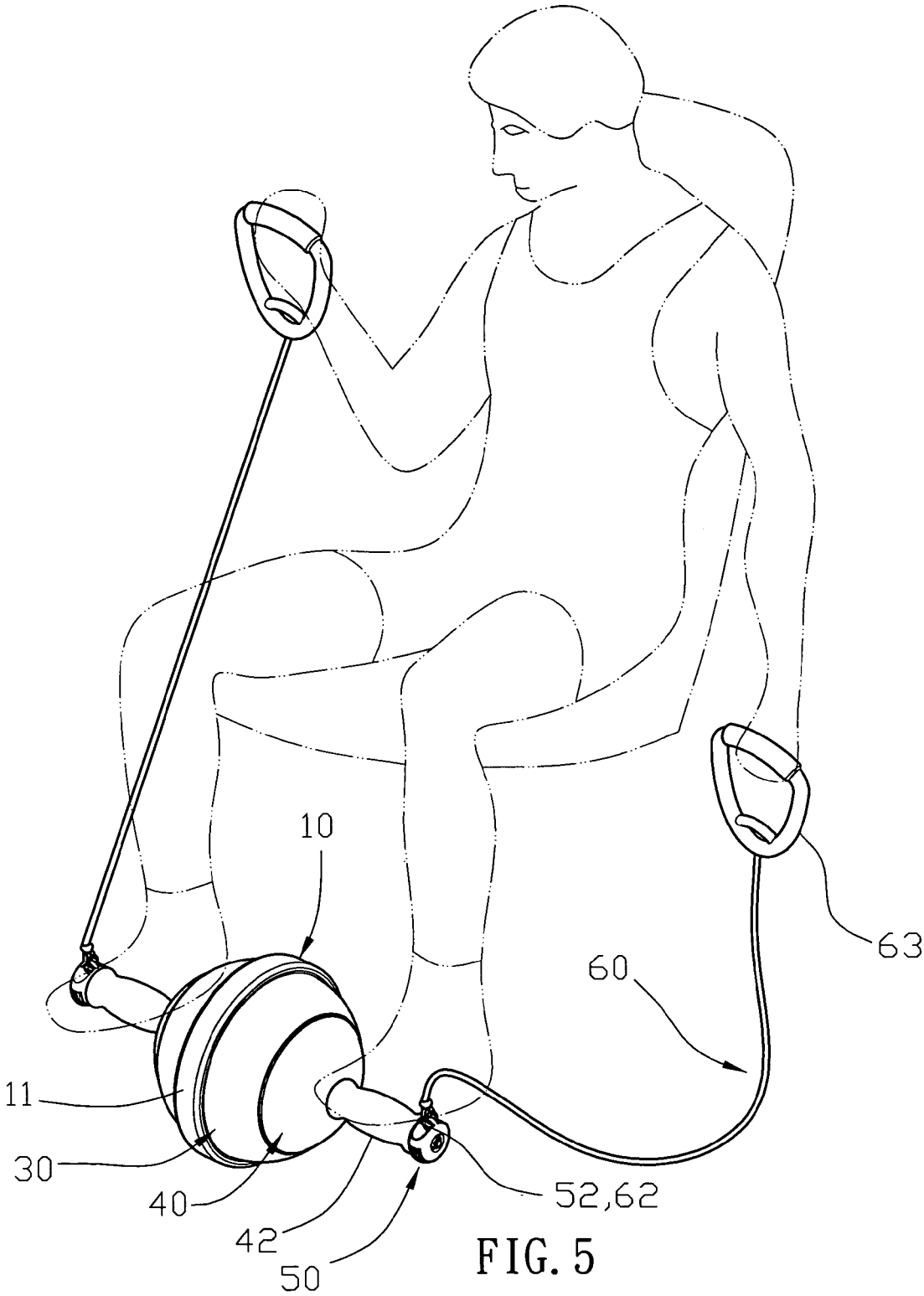
FIG. 5 is a schematic perspective operational view of the exercising device as shown in FIG. 1.

Referring to FIG. 5 with reference to FIGS. 1 and 2, each of the two pull cords 60 is attached to a respective one of the two fixing members 50, and the rotation disk 10 is placed on the ground. Thus, when a user is seated on a chair, his two legs steps on the grip portion 42 of each of the two handles 40 to drive the rotation disk 10 to rotate on the ground and his two hands hold and apply a force to the holding portion 63 of each of the two pull cords 60 to extend the two pull cords 60, thereby exercising the user's two arms and two feet.

Figure 6:
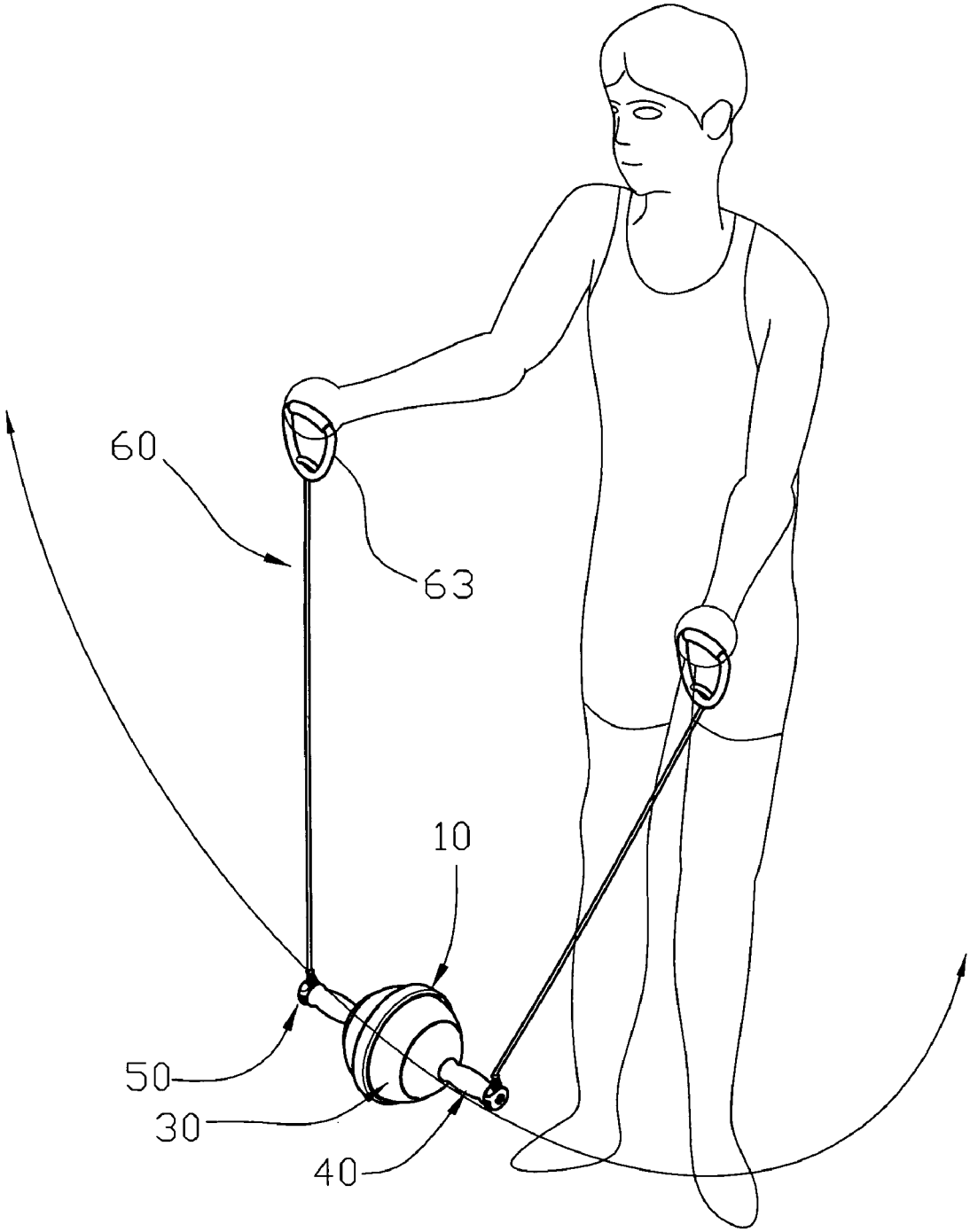
FIG. 6 is a schematic perspective operational view of the exercising device as shown in FIG. 1.

Referring to FIG. 6 with reference to FIGS. 1 and 2, each of the two pull cords 60 is attached to a respective one of the two fixing members 50. Thus, when a user stands up, his two hands hold and apply a force to the holding portion 63 of each of the two pull cords 60 to suspend the rotation disk 10 in the air and to swing the whole exercising device, thereby exercising the user's two arms and his back.

Figure 7:
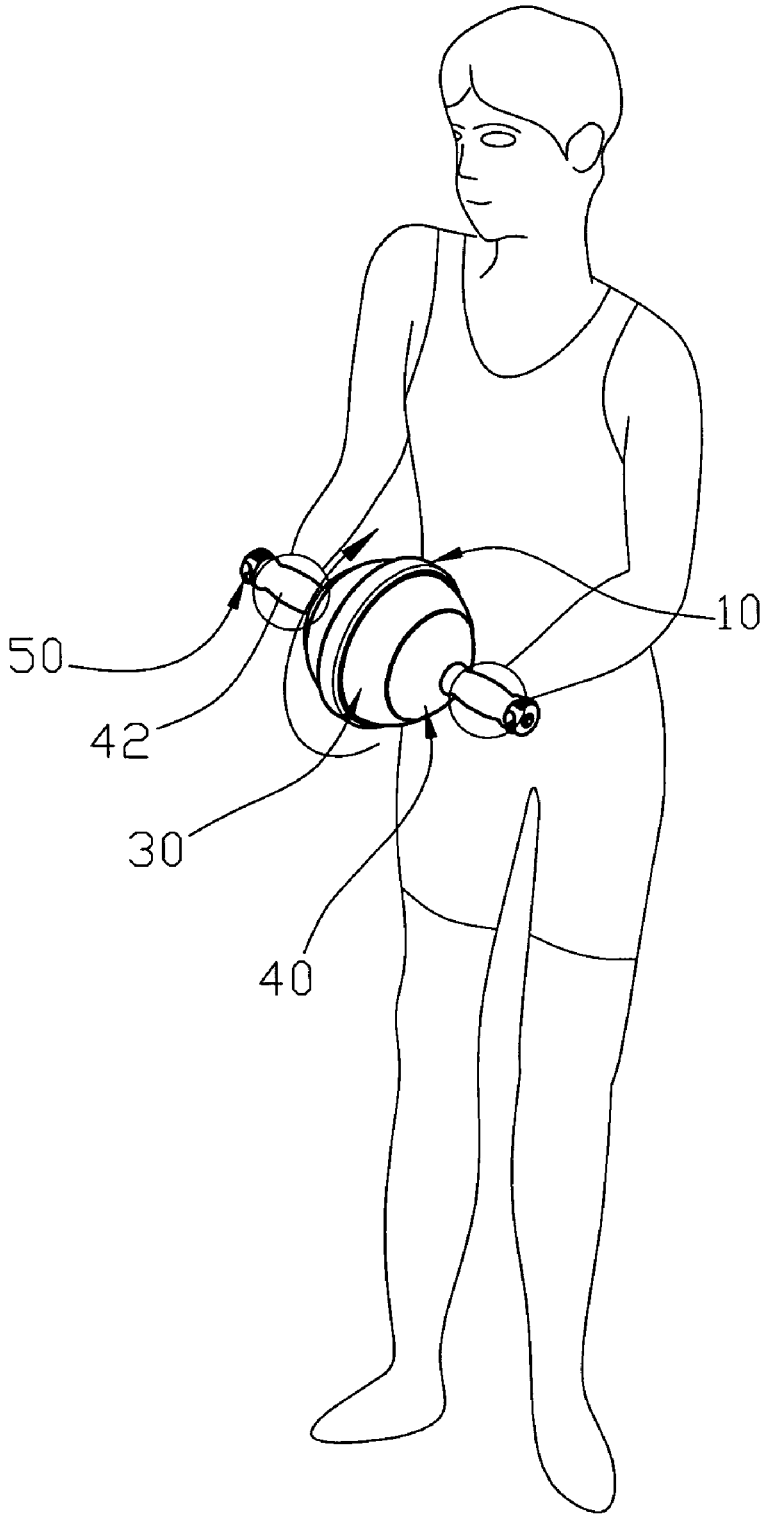
FIG. 7 is a schematic perspective operational view of the exercising device as shown in FIG. 1.

Referring to FIG. 7 with reference to FIGS. 1 and 2, each of the two pull cords 60 is removed from a respective one of the two fixing members 50. Thus, when a user stands up, his two hands hold and apply a force to the grip portion 42 of each of the two handles 40 to shake the rotation disk 10 so that the rotation disk 10 is rotated relative to the two handles 40 so as to rotate the weight 13 eccentrically, thereby exercising the user's two arms and hands.

Figure 8:
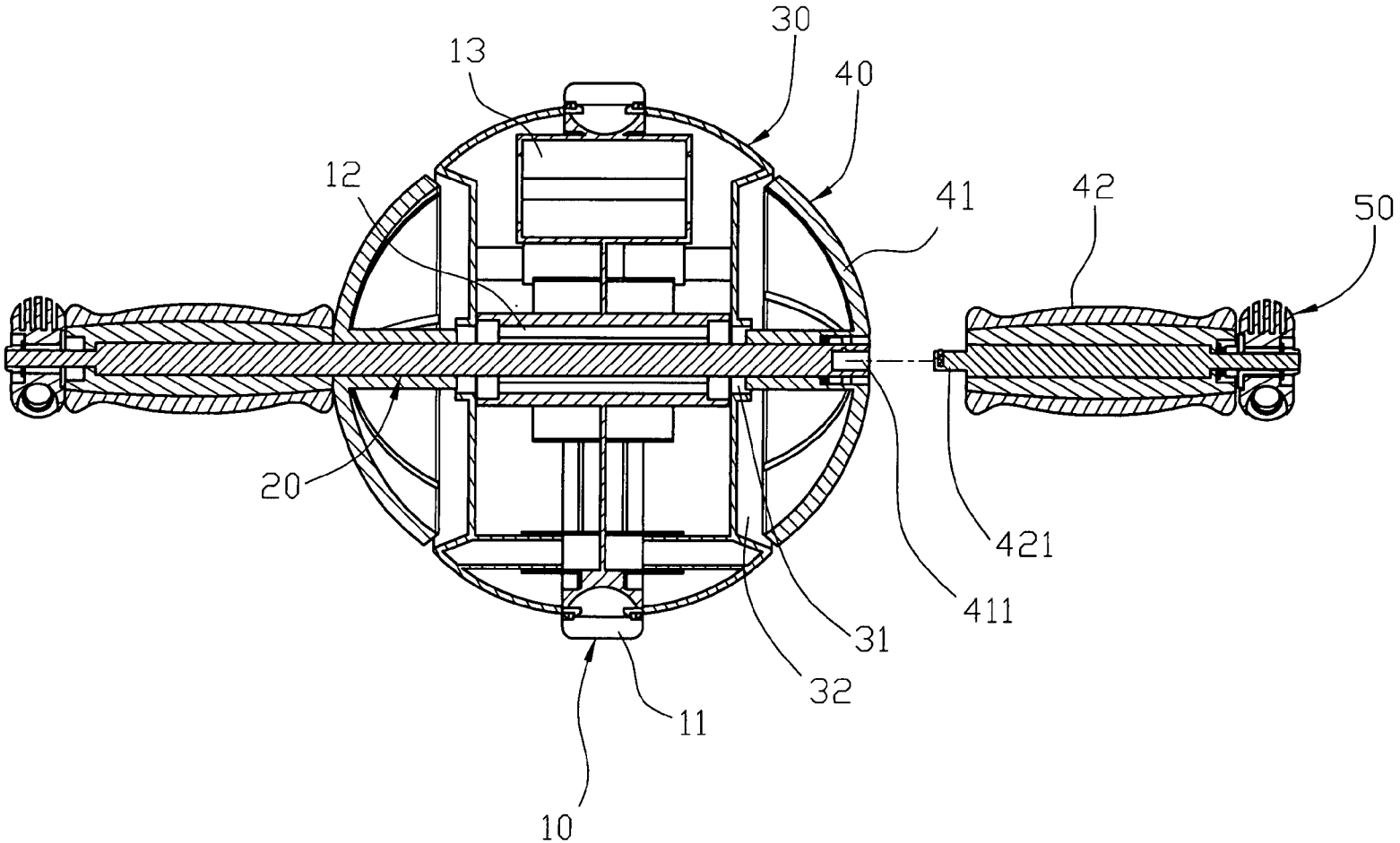
FIG. 8 is a partially plan exploded cross-sectional view of an exercising device in accordance with another embodiment of the present invention.

Referring to FIG. 8, one of the two handles 40 is detachably mounted on the shaft 20 and includes a support disk 41 rested on the respective connecting member 30 and having a side formed with a mounting recess 411, and a grip portion 42 detachably mounted on the support disk 41 and having an end formed with a mounting portion 421 detachably mounted in the mounting recess 411 of the support disk 41.

Figure 9:
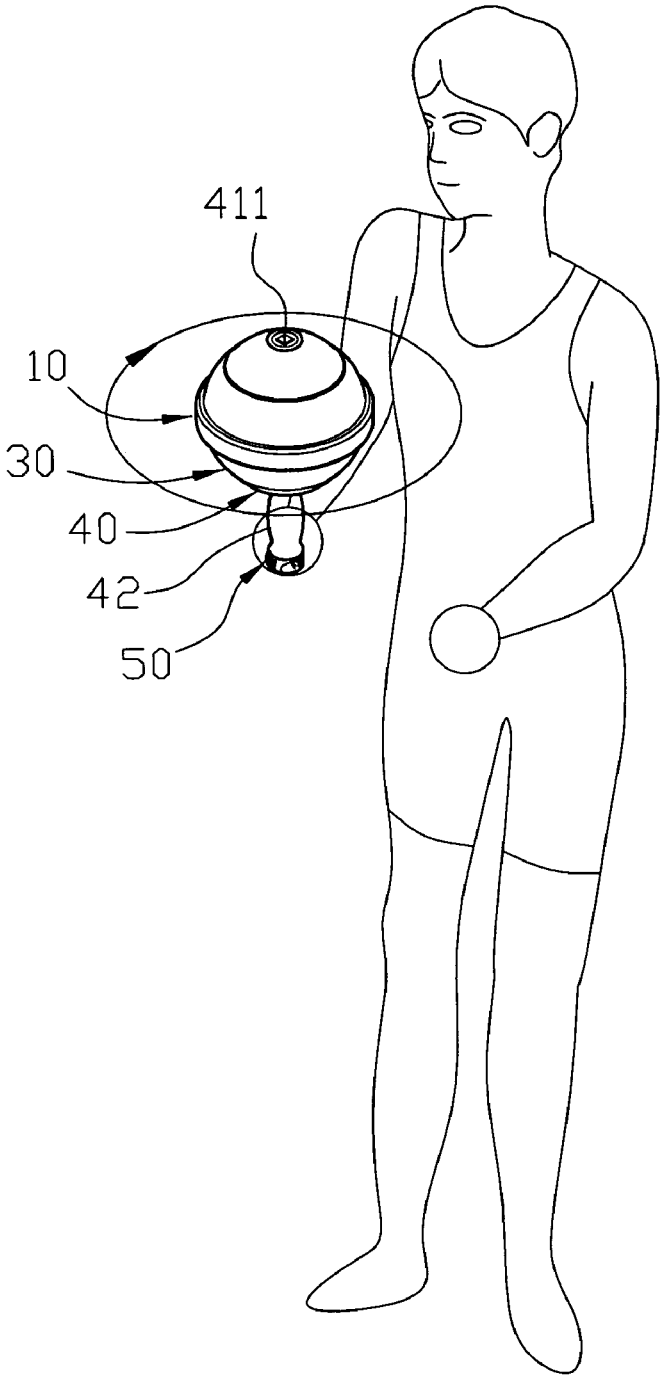
FIG. 9 is a schematic perspective operational view of the exercising device as shown in FIG. 8.

Referring to FIG. 9, one of the two handles 40 is removed from the shaft 20 so that the user's one hand can hold the grip portion 42 of the other handle 40 to shake and rotate the rotation disk 10 so as to rotate the weight 13 eccentrically, thereby exercising the user's one arm and hand.

Accordingly, when a user faces the ground, his two hands hold and apply a force to the grip portion 42 of each of the two handles 40 so that the two handles 40 are moved forward and forward successively to drive the rotation disk 10 to rotate on the ground, thereby exercising the user's two arms and his abdomen. In addition, when a user is seated on a chair, his two legs steps on the grip portion 42 of each of the two handles 40 to drive the rotation disk 10 to rotate on the ground and his two hands hold and apply a force to the holding portion 63 of each of the two pull cords 60 to extend the two pull cords 60, thereby exercising the user's two arms and two feet. Further, when a user stands up, his two hands hold and apply a force to the holding portion 63 of each of the two pull cords 60 to suspend the rotation disk 10 in the air and to swing the whole exercising device, thereby exercising the user's two arms and his back. Further, when a user stands up, his two hands hold and apply a force to the grip portion 42 of each of the two handles 40 to shake the rotation disk 10 so that the rotation disk 10 is rotated relative to the two handles 40 so as to rotate the weight 13 eccentrically, thereby exercising the user's two arms and hands. Further, when one of the two handles 40 is removed, the user's one hand can hold the grip portion 42 of the other handle 40 to shake and rotate the rotation disk 10 so as to rotate the weight 13 eccentrically, thereby exercising the user's one arm and hand.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An exercising device, comprising:

a shaft;

a rotation disk rotatably mounted on the shaft;

a weight mounted on the rotation disk eccentrically;

two connecting members rotatably mounted on the shaft and located at two sides of the rotation disk;

two handles each secured on the shaft and each rested on a respective one of the two connecting members;

wherein each of the two handles has a first end formed with a support disk rested on the respective connecting member and a second end formed with a grip portion;

and wherein the rotation disk is rotated relative to one or both of the handles by a user during exercise so as to rotate the weight eccentrically and thereby exercising at least one or both of a user's arms.

2. The exercising device in accordance with claim 1, wherein each of the two handles has a central portion formed with a mounting hole mounted on the shaft.

3. The exercising device in accordance with claim 1, wherein each of the two connecting members has a side formed with a circular receiving recess, and the support disk of each of the two handles is rotatably mounted in the receiving recess of the respective connecting member so that each of the two connecting members is rotatable relative to the respective handle when the rotation disk is rotated.

4. An exercising device, comprising:

a shaft;

a rotation disk rotatably mounted on the shaft;

a weight mounted on the rotation disk eccentrically;

two connecting members rotatably mounted on the shaft and located at two sides of the rotation disk;

two handles each secured on the shaft and each rested on a respective one of the two connecting members;

two fixing members each secured on the shaft and each rested on a respective one of the two handles;

wherein the rotation disk is rotated relative to one or both of the handles by a user during exercise so as to rotate the weight eccentrically and thereby exercising at least one or both of a user's arms.

5. The exercising device in accordance with claim 4, wherein the shaft has two ends each formed with a threaded locking portion protruded outward from the grip portion of each of the two handles, and each of the two fixing members has a central portion formed with a threaded locking hole locked onto the respective locking portion of the shaft and has a side formed with a snapping portion.

6. The exercising device in accordance with claim 5, further comprising two pull cords each detachably attached to a respective one of the two fixing members.

7. The exercising device in accordance with claim 6, wherein each of the two pull cords has a first end provided with a snapping head detachably snapped into snapping portion of the respective fixing member and a second end provided with a loop-shaped holding portion.

8. The exercising device in accordance with claim 4, wherein one of the two handles is detachably mounted on the shaft and includes a support disk rested on the respective connecting member and having a side formed with a mounting recess, and a grip portion detachably mounted on the support disk and having an end formed with a mounting portion detachably mounted in the mounting recess of the support disk.

* * * * *